United States Patent [19]

Harter

[11] Patent Number: 4,898,101

[45] Date of Patent: Feb. 6, 1990

[54] VEHICLE HOPPER BODY WITH INTERNAL REINFORCING MEMBERS

[75] Inventor: Lynn J. Harter, Atlanta, Ga.

[73] Assignee: Thrall Car Manufacturing Company, Chicago Heights, Ill.

[21] Appl. No.: 245,572

[22] Filed: Sep. 19, 1988

[51] Int. Cl.[4] ..... B61D 3/00; B61D 7/00

[52] U.S. Cl. ..... 105/247; 105/358; 105/406.1; 105/248

[58] Field of Search ..... 105/247, 248, 249, 411, 105/417, 256, 360, 358, 406.1, 406.2

[56] References Cited

U.S. PATENT DOCUMENTS

| | | | |
|---|---|---|---|
| 3,391,445 | 7/1968 | Miller | 105/406.1 X |
| 3,490,387 | 1/1970 | Halcomb | 105/406.1 X |
| 3,543,692 | 12/1970 | Stark et al. | 105/358 X |
| 3,713,399 | 1/1973 | Bembridger et al. | 105/248 X |
| 4,165,086 | 8/1979 | Glassmeyer | 105/358 X |
| 4,230,048 | 10/1980 | Gordon et al. | 105/358 X |
| 4,352,331 | 10/1982 | Anderson et al. | 105/248 |
| 4,696,237 | 9/1987 | Miller | 105/248 |

FOREIGN PATENT DOCUMENTS

| | | | |
|---|---|---|---|
| 1089711 | 11/1980 | Canada | 105/248 |

*Primary Examiner*—Douglas C. Butler

*Attorney, Agent, or Firm*—Marshall, O'Toole, Gerstein, Murray & Bicknell

[57] ABSTRACT

A hopper vehicle body having an elongated shell internally reinforced by spaced apart lateral reinforcing members in the general shape of a horseshoe and which have a hat-shaped cross section.

5 Claims, 4 Drawing Sheets

FIG. 4
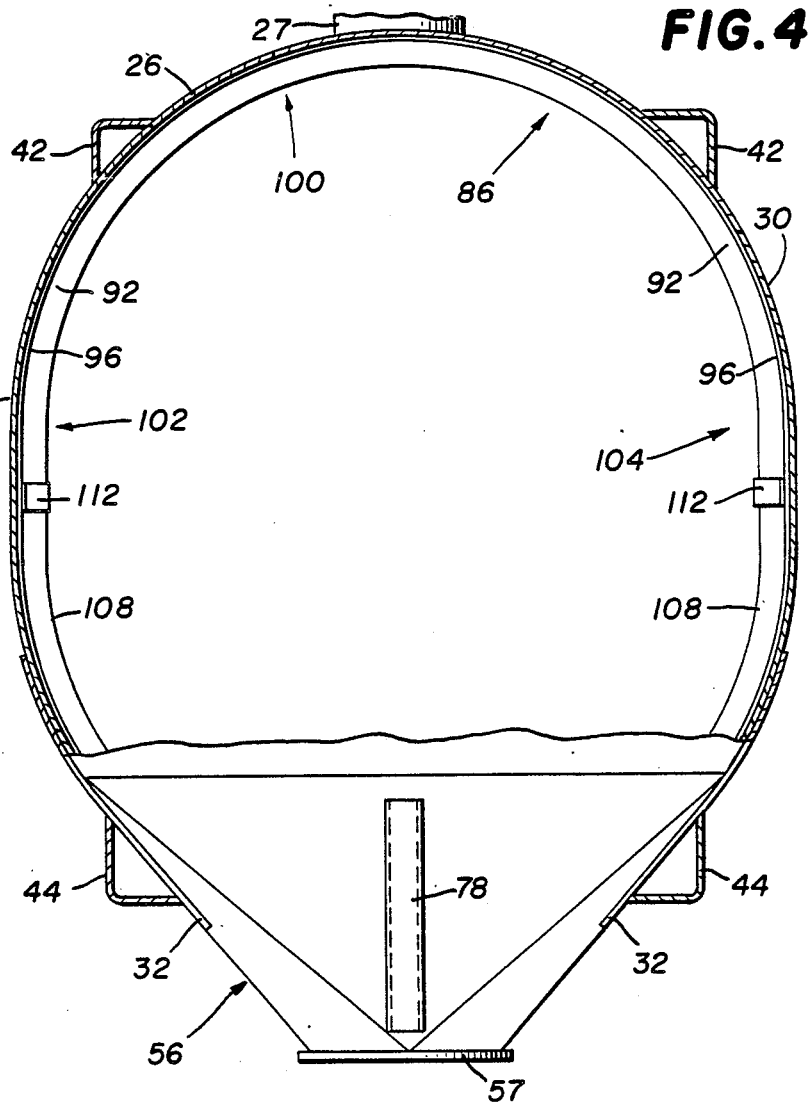
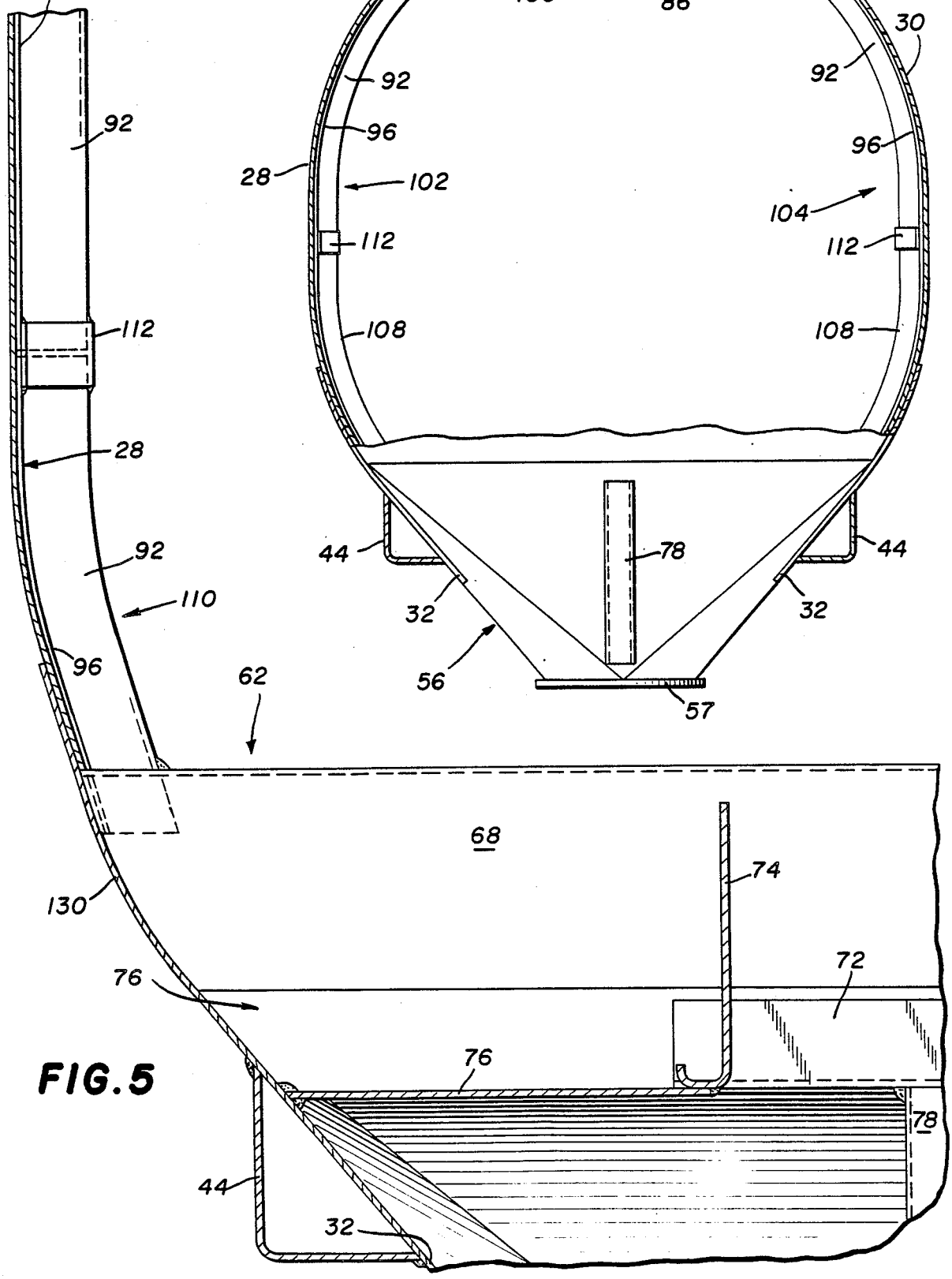
FIG. 5

VEHICLE HOPPER BODY WITH INTERNAL REINFORCING MEMBERS

This invention relates to hopper-containing vehicles for transporting solid particulate or granular material over highways and railroads. More particularly, this invention is concerned with a hopper-containing vehicle having an improved body which permits elimination of internal crossbracing.

BACKGROUND OF THE INVENTION

Hopper-containing vehicles are widely used on railroads and highways to transport a variety of granular materials such as grain, sand, flour, polymeric pellets and various chemicals and fertilizers. Since many of these materials would be harmed or become contaminated if exposed to the atmosphere, including rain, snow and wind, they are usually transported in closed hopper vehicles.

To facilitate unloading of granular or particulate lading from a closed hopper vehicle, systems have been developed to increase the internal atmospheric pressure in the hopper vehicle body so that flowing lading is fluidized and propelled through and out of the hopper discharge gates or ports. One such vehicle, and particularly a railway hopper car, is disclosed in Anderson et al U.S. Pat. No. 4,352,331.

The railroad hopper car body disclosed in the Anderson et al patent comprises an elongated closed metal shell with spaced apart internal lateral ribs or rings made of channel-shaped members having the channel flange toes welded to the internal surface of the shell. This structural arrangement first used a 0.25 in. thick side sheet and a 0.187 in. thick roof sheet plus lateral braces extending across the car body and connected at each end to the channel ring. This design was found to have high roof sheet stresses adjacent to the crossbrace connection to the internal ring. To handle the high stresses the thickness of the roof sheet was increased to 0.25 in. This added significantly to the weight of the car.

The presence of the crossbraces was also a problem in the area of their connections in vehicles which require a special internal coating or lining. Furthermore, crossbraces are obstacles to lading flow and add weight to the vehicle or car.

From the above discussion, it is clear that there is a need for an improved hopper vehicle body which is internally reinforced and does not require internal crossbracing.

SUMMARY OF THE INVENTION

According to the invention there is provided a hopper vehicle body comprising an elongated shell having a top and opposing side walls and having an arcuate lateral sectional profile in the general shape of a horseshoe with the side walls terminating in a lower horizontal edge; each end of the elongated shell being closed by an end wall means; the elongated shell having a plurality of spaced apart lateral crossridge means extending between the opposing side walls near the horizontal edges; a plurality of discharge hoppers enclosing the vehicle body beneath and connected to the elongated shell; each of the lateral crossridge means constituting a common top separating adjoining discharge hoppers; a plurality of horseshoe-shaped reinforcement members located inside of the elongated shell; a separate horseshoe-shaped reinforcement being positioned along a plane lateral to the elongated shell so as to bisect each crossridge means; each horseshoe-shaped reinforcement having a hat shape in lateral section and comprising a top, a pair of opposing sides extending vertically outward from the top side edges, and a rim parallel to the top extending outward from each side and away from each other and terminating in an edge; each rim of the hat-shaped reinforcement being joined to the elongated-shell; and each horseshoe-shaped reinforcement member terminating in two lower opposing ends, with one of each of the two ends being joined to an end of an adjoining crossridge means.

The crossridge means can be formed by the intersection of walls of adjoining hoppers. Also, each crossridge means can be substantially horizontal with sloping sides.

Each horseshoe-shaped reinforcement can comprise an upper arcuate portion which terminates in substantially straight vertical parallel legs, and lower portions comprising a separate arcuate leg extension joined to each upper portion parallel leg.

BRIEF DESCRIPTION OF THE DRAWINGS

FIG. 4 is a sectional view taken along the line 4—4 of FIG. 3;

FIG. 5 is a sectional view taken along the line 5—5 of FIG. 3;

DETAILED DESCRIPTION OF THE DRAWINGS

To the extent it is reasonable and practical, the same or similar elements which appear in the various views of the drawings will be identified by the same or similar numbers.

Figure 1:
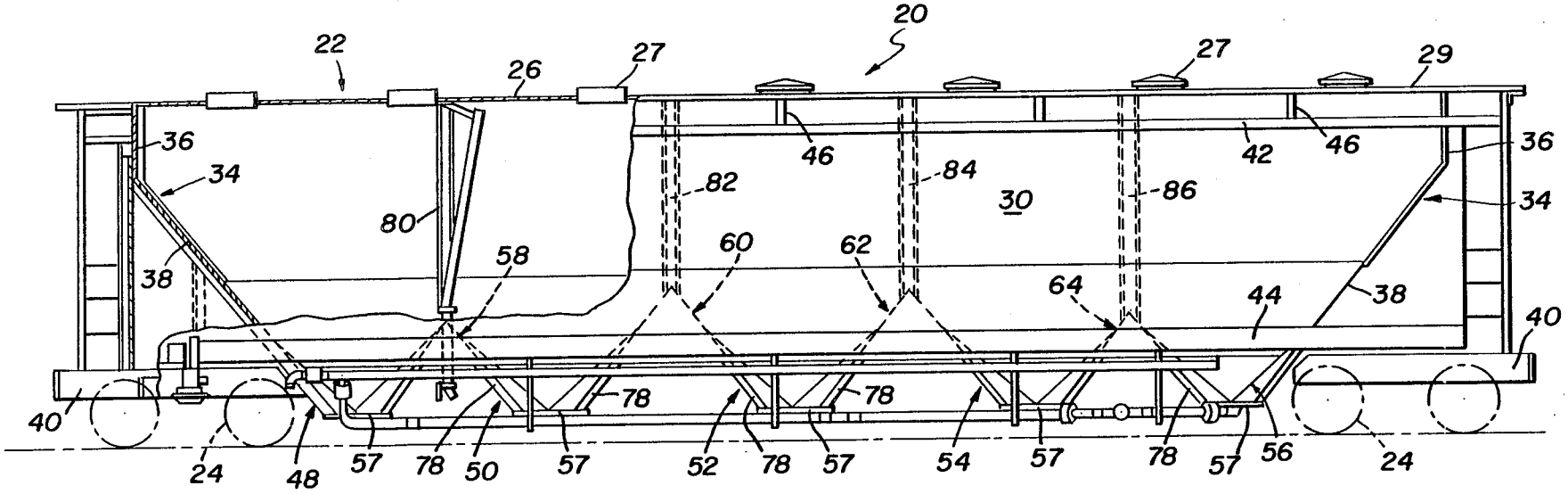
FIG. 1 is a side elevational view, partially broken away, of a railroad hopper car incorporating the inventions disclosed herein.
Figure 2:
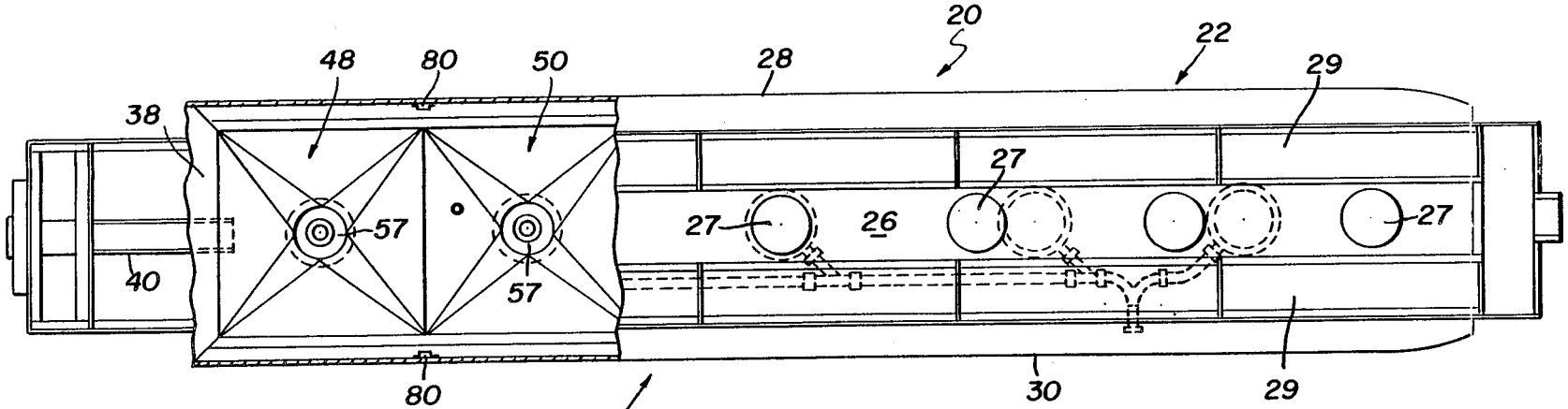
FIG. 2 is a plan view, partially broken away and in horizontal section, of the hopper car shown in FIG. 1.

With reference to the drawings and initially primarily FIGS. 1 and 2, the railroad hopper car 20 is of the type generally referred to as a pressure differential car because it is designed to withstand an increased pressure, generally up to about one atmospheric pressure, above atmospheric pressure. The car as shown in some of the drawings thus has appropriate piping to supply the air needed to increase the car internal pressure, as well as piping which distributes the air to facilitate unloading the car, all of which has been previously disclosed in the prior art, as see Anderson et al. U.S. Pat. No. 4,352,331 and which does not form part of the subject invention.

The railroad hopper car 20 will be seen to include a body 22 which is supported at each end on a railroad bogie or truck 24. The body 22 comprises an elongated shell having a top 26 and a pair of opposing side walls 28, 30. The top 26 is shown as provided with seven covered inlet ports 27 although fewer or more ports can be provided. A pair of longitudinal parallel walkways 29 are mounted on each side of the row of inlet ports 27. Each of the side walls 28, 30 terminates in a lower horizontal edge 32. Each end of the elongated shell is closed by an end wall 34, part of which is vertical 36 and the lower part of which is a slope sheet 38 (FIG. 1). The entire body 22 is supported at each end by stub center sills 40 through body bolsters which rest on the trucks 24.

Figure 3:
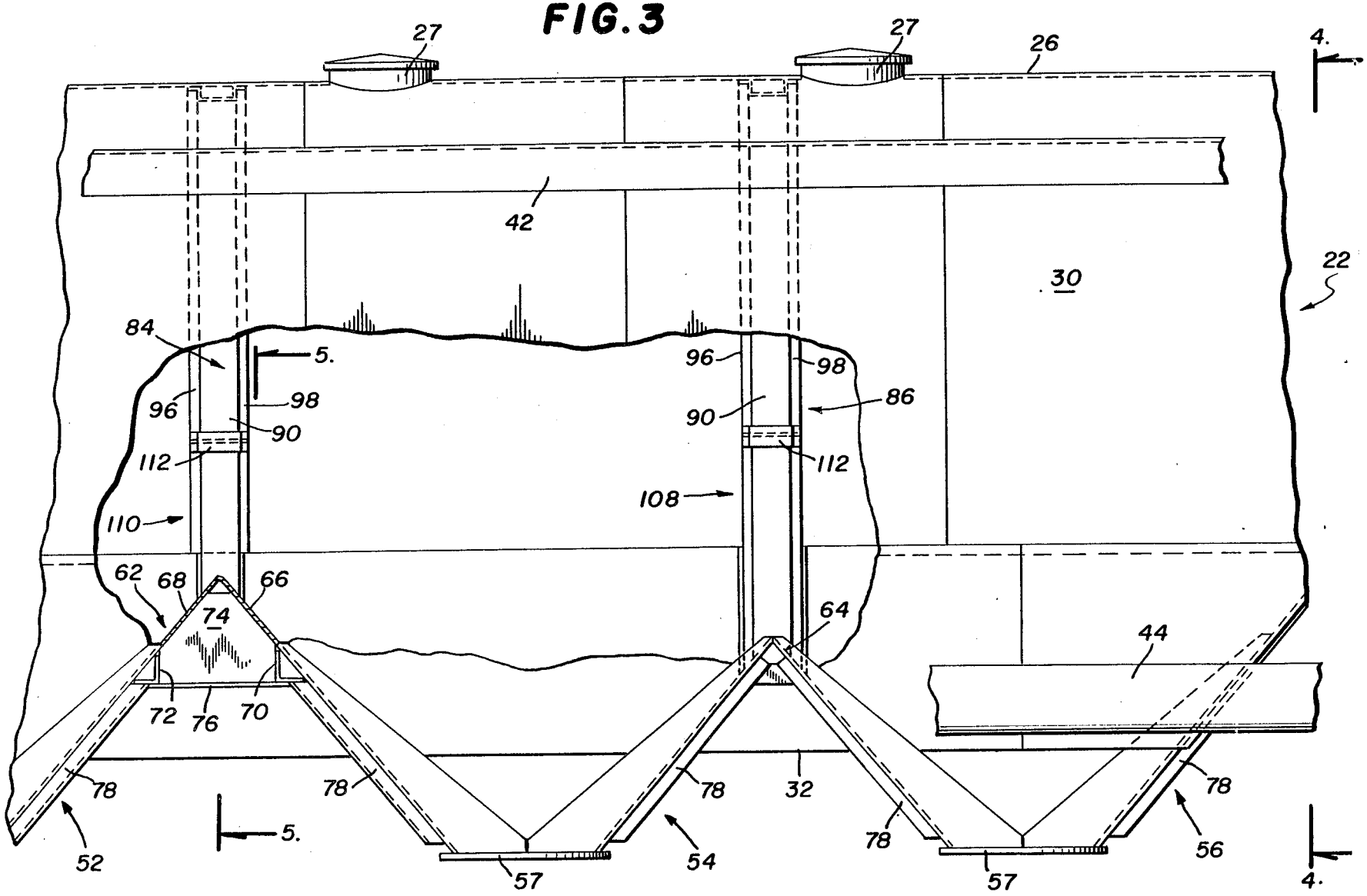
FIG. 3 is an enlarged side elevational view, partially broken away and in section, of an end portion of the railroad hopper car shown in FIGS. 1 and 2.

The elongate shell has a top side plate 42 on each side of the shell top 26 and a bottom side sill 44 on each of the opposing side walls 28, 30 (FIGS. 1, 3, 4). The walkways 29 are partially supported by vertical legs 46 which have their lower ends joined to top side plates 42 (FIG. 1).

Five discharge hoppers 48, 50, 52, 54, 56 are connected to the elongated shell and enclose the car body. The discharge hoppers are essentially identical in that the lower portions thereof are truncated conical shells having essentially the same size and shape and with each terminating in a horizontal discharge opening 57 of the same diameter.

The elongated shell also has four spaced apart lateral horizontal crossridge members 58, 60, 62, 64 extending between the opposing side walls 28, 30 and located near but above the horizontal edges 32. The crossridge members 58, 64 are identical to each other but are positioned lower than the crossridge members 60, 62, which are also identical to each other but are different than crossridge members 58,64 (FIGS. 1, 3). Each of the crossridges constitutes a common top separating adjoining discharge hoppers.

The crossridge members 58, 64 are formed by the intersection of the top straight but sloping portions of two adjacent hoppers. Thus, crossridge 58 is formed by the intersecting top portions of hoppers 48, 50. Similarly, crossridge 64 is formed by the intersecting top portions of hoppers 54, 56. Each of the crossridges 58, 64 has the general shape of a straight angle structural member inverted with the flanges at about 40°. It should be understood, however, that the crossridges 58, 64 are integral with the lower hopper walls and are not separate structural members.

It will be seen that the crossridges 60, 62 are located higher than the crossridges 58, 64. The crossridges 60, 62 are located higher because of the predetermined length of the car and the desire to maintain the same internal slope for all the hopper walls. By reducing the distance between hoppers 50, 52, and between hoppers 52, 54, the crossridges 60, 62 would be inherently lowered until they are at the same height as crossridges 58, 64.

Each of the crossridges 60, 62 comprises a pair of oppositely sloping plates 66, 68 (FIG. 3) which extend the width of the car and are joined to the sidewalls 28, 30. The lower edges of plates 66, 68 are connected to the upper edge of the respective hoppers; thus, plates 66, 68 of crossridge 62 are connected to the upper edge of hoppers 54, 52. Angle members 70, 72 reinforce the plates 66, 68. Spaced apart vertical plates 74 are also joined to the bottom of plates 66, 68 for reinforcement. The bottom portion of plates 74 is shaped like a J for stiffening purposes. Also, horizontal plate 76 is joined to the bottom edge of vertical plates 74 for additional reinforcement.

Each of the hoppers 48, 50, 52, 54, 56 is provided with a reinforcing channel member 78, joined to the outer surface thereof, and extending in a downwardly sloping direction from a crossridge to adjacent to a hopper discharge opening 57. The channel members 78 are located in a vertical plane through the longitudinal center line of the car. The trough side of each channel member 78 faces inward toward the hopper outer surface.

Four horseshoe-shaped reinforcement members 80, 82, 84, 86 are located inside of and are joined to the inner surface of the elongated shell 22. The horseshoe-shaped members 80, 86 are identical, and the horseshoe-shaped members 82, 84 are identical.

Horseshoe-shaped member 80 is positioned along a vertical plane lateral to the elongated shell 22 so as to bisect crossridge member 58. Horseshoe-shaped member 86 is similarly positioned to bisect crossridge member 64.

Horseshoe-shaped member 82 is positioned along a vertical plane lateral to the elongated shell 22 so as to bisect crossridge member 60. Similarly, horseshoe-shaped member 84 is positioned to bisect crossridge member 62.

Figure 7:
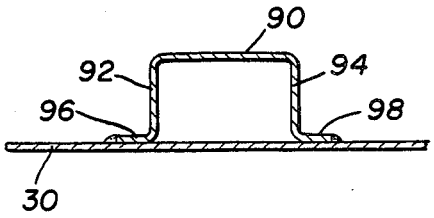
FIG. 7 is a sectional view taken along the line 7—7 of FIG. 6.
Figure 8:
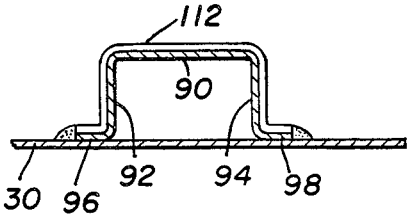
FIG. 8 is a sectional view taken along the line 8—8 of FIG. 6.

Each of the horseshoe-shaped members 80, 82, 84, 86 is hat-shaped in lateral cross section and has essentially the same cross sectional dimensional size and the same shape. Each horseshoe-shaped member has a top 90, a pair of opposing sides 92, 94 extending vertically outward from the top 90 side edges, and a rim 96, 98 parallel to the top extending outward from the respective sides 92, 94 (FIGS. 7, 8). The outer edge of each of the runs 96, 98 is welded to the inside surface of the elongated shell 22.

Each of the horseshoe-shaped reinforcement members 80, 82, 84, 86 is a roll-formed structural member which includes an upper arcuate portion 100 terminating in identical substantially straight vertical parallel legs 102, 104 (FIG. 4). However, each of the horseshoe-shaped members 80, 82, 84, 86 includes a lower portion comprising a separate arcuate leg extension joined to each upper portion parallel leg.

Each of the two horseshoe-shaped members 80, 86 includes an arcuate extension 108 joined to the end of the straight portions 102, 104. A hat-shaped cover is located over the joint formed by the abutting ends of straight portion 102 or 104 with an arcuate extension 108. The lower end of each arcuate extension 108 is joined to the top of the crossridge 64 or 58 (FIGS. 1 and 3).

Figure 6:
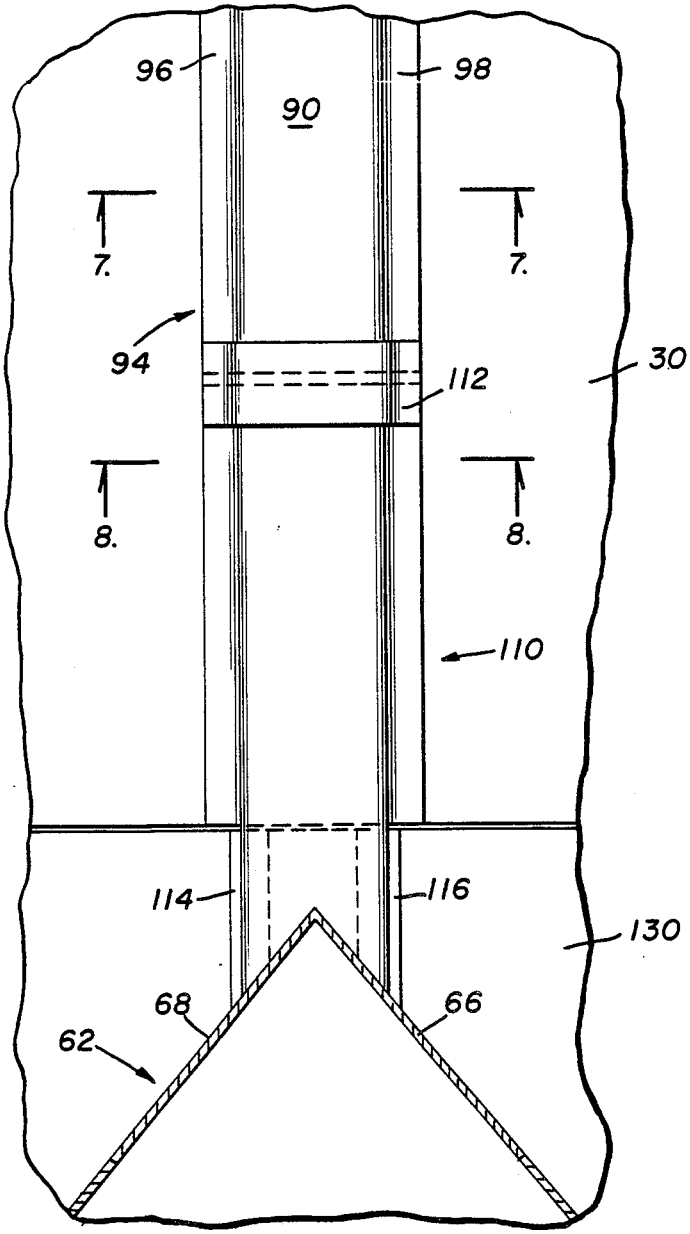
FIG. 6 is an enlarged elevational view, partially in section, of the lower portion of a horseshoe-shaped reinforcement.

The two horseshoe-shaped members 82, 84 include an arcuate extension 110 joined to the end of the straight portions 102, 104. A hat-shaped cover 112 is located over the joint formed by the abutting ends of the straight portion 102 or 104 with an arcuate extension 110 (FIGS. 3 and 6). The rim 98 is removed from the lower end portion of each arcuate extension to provide a transition from overlapping side wall 28 to the wall 130 of the hopper top. Two flat filler bars 114, 116 (FIG. 6) are positioned so that one lies beneath the side 92 and the other beneath the side 94 of arcuate extension 110.

By means of the use of horseshoe-shaped reinforcements which are hat-shaped in cross section rather than a channel, it was determined that the previously required crossbraces could be eliminated with a savings in weight and cost, elimination of problems in lining the car when necessary, plus better flow of the product during emptying. The resulting vehicle body is characterized by an essentially clear interior space since it is unobstructed by crossbraces. The hat-shaped structure is a flexible flanged member which leads to reduced roof sheet stress. Because of the reduction in roof sheet stress, the thickness of the elongated shell roof sheet can be decreased as, for example, from b 3/16" to 5/32" rather than increased to ¼" when crossbraces are used with channel member reinforcements. A savings in car body weight results from use of the thinner sheets.

The foregoing detailed description has been given for clearness of understanding only and no unnecessary limitations should be understood therefrom, as modifications will be obvious to those skilled in the art.

What is claimed is:

1. A hopper vehicle body comprising:

an elongated shell having a top and opposing side walls and having an arcuate lateral sectional profile in the general shape of a horseshoe with the side walls terminating in a lower horizontal edge;

each end of the elongated shell being closed by an end wall means;

the elongated shell having a plurality of spaced apart lateral crossridge means extending between the opposing side walls near but above the horizontal edges;

a plurality of discharge hoppers enclosing the vehicle body beneath and connected to the elongated shell;

each of the lateral crossridge means constituting a common top separating adjoining discharge hoppers;

a plurality of horseshoe-shaped reinforcement members located inside of the elongated shell;

each of the horseshoe-shaped reinforcements being positioned along a plane lateral to the elongated shell so as to intersect each crossridge means;

each horseshoe-shaped reinforcement having a hat shape in lateral section and comprising a top, a pair of opposing sides extending outward from the top side edges, and a rim parallel to the top extending outward from each side and terminating in an edge;

each rim of the hat-shaped reinforcement being joined to the elongated-shell; and each horseshoe-shaped reinforcement member terminating in two lower opposing ends, with one of each of the two ends being joined to and of an adjoining crossridge means.

2. A hopper vehicle body according to claim 1 in which the crossridge means is formed by the intersection of walls of adjoining hoppers.

3. A hopper vehicle body according to claim 1 in which each crossridge means is substantially horizontal with sloping sides.

4. A hopper vehicle body according to claim 1 in which each horseshoe-shaped reinforcement comprises an upper arcuate portion terminating in substantially straight vertical parallel legs, and lower portions comprising a separate arcuate leg extension joined to each upper portion parallel leg.

5. A hopper vehicle body according to claim 1 in which the body has an essentially clear interior space unobstructed by crossbraces.

* * * * *

UNITED STATES PATENT AND TRADEMARK OFFICE

CERTIFICATE OF CORRECTION

PATENT NO. : 4,898,101

DATED : February 6, 1990

INVENTOR(S) : LYNN J. HARTER

It is certified that error appears in the above-identified patent and that said Letters Patent is hereby corrected as shown below:

Column 4, line 39, after "cover" insert -- 112 --;

column 5, line 1, delete "b".

Signed and Sealed this

Twenty-fifth Day of December, 1990

*Attest:*

HARRY F. MANBECK, JR.

*Attesting Officer*

*Commissioner of Patents and Trademarks*